US009382753B2

(12) United States Patent
Lin

(10) Patent No.: US 9,382,753 B2
(45) Date of Patent: Jul. 5, 2016

(54) WINDOW COVERING

(75) Inventor: Tzong-Fu Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 1043 days.

(21) Appl. No.: 13/042,717

(22) Filed: Mar. 8, 2011

(65) Prior Publication Data

US 2012/0227910 A1 Sep. 13, 2012

(51) Int. Cl.

| | |
|---|---|
| ***A47H 5/00*** | (2006.01) |
| ***E06B 9/262*** | (2006.01) |
| ***E06B 9/382*** | (2006.01) |

(52) U.S. Cl.

CPC ..... *E06B 9/262* (2013.01); *E06B 9/382* (2013.01); *E06B 2009/2622* (2013.01)

(58) Field of Classification Search

CPC .. E06B 9/262; E06B 2009/2622; E06B 9/382
USPC ..... 160/84.01, 84.03, 84.04, 348, 193, 160/168.1 R, 173 R, 340, 344
See application file for complete search history.

(56) References Cited

U.S. PATENT DOCUMENTS

| | | | | | |
|---|---|---|---|---|---|
| 1,321,800 | A | | 11/1919 | Andress et al. | |
| 2,295,137 | A | * | 9/1942 | Sutton | 160/84.01 |
| 2,586,340 | A | | 2/1952 | Hyde | |
| 2,678,094 | A | | 5/1954 | Sargent | |
| 3,160,202 | A | * | 12/1964 | Rosen | 160/344 |
| 3,371,700 | A | * | 3/1968 | Romano | 160/84.01 |
| 3,952,788 | A | * | 4/1976 | Scholer | 160/84.01 |
| 4,096,904 | A | | 6/1978 | Donofrio | |
| D277,061 | S | * | 1/1985 | Picoy | D6/575 |
| 4,681,279 | A | | 7/1987 | Nakamura | |
| 4,765,388 | A | * | 8/1988 | Dohlemann | 160/84.01 |
| 4,909,298 | A | | 3/1990 | Langhart et al. | |
| 5,205,333 | A | * | 4/1993 | Judkins | 160/84.02 |
| 5,205,334 | A | * | 4/1993 | Judkins | 160/89 |
| 5,482,105 | A | | 1/1996 | Rude | |
| 5,533,559 | A | | 7/1996 | Judkins | |
| 5,566,735 | A | | 10/1996 | Jelic | |
| 5,613,540 | A | * | 3/1997 | Jelic | 160/84.04 |

(Continued)

FOREIGN PATENT DOCUMENTS

WO WO 2010021841 A1 * 2/2010

OTHER PUBLICATIONS

U.S. Appl. No. 12/755,477, filed Apr. 7, 2010.

(Continued)

*Primary Examiner* — Katherine Mitchell
*Assistant Examiner* — Johnnie A Shablack
(74) *Attorney, Agent, or Firm* — Buchanan Ingersoll & Rooney PC

(57) ABSTRACT

A window covering includes a liner positioned adjacent to the rear side of window covering material. The liner is attached to at least one of the window covering material and a first rail to define at least one cavity between the window covering material and the liner. At least one ladder is attached to the liner and positioned in the at least one cavity. The at least one ladder has vertically spaced rungs. At least one lift cord extends from the first rail to a position adjacent to the bottom edge of the window covering material. The at least one cord passes adjacent to the at least one ladder such that the at least one lift cord passes over the rungs of the at least one ladder such that the at least one lift cord alternates from passing behind and in front of successive rungs.

20 Claims, 4 Drawing Sheets

(56) References Cited

U.S. PATENT DOCUMENTS

| | | | | |
|---|---|---|---|---|
| 5,630,458 | A | 5/1997 | Holden | |
| 5,738,159 | A * | 4/1998 | O'Brien | 160/84.01 |
| 5,787,951 | A * | 8/1998 | Tonomura et al. | 160/84.01 |
| 5,791,392 | A * | 8/1998 | Fernandez Lopez | 160/238 |
| 5,862,850 | A * | 1/1999 | Yang | 160/84.04 |
| 5,894,876 | A * | 4/1999 | O'Brien | 160/84.01 |
| 6,082,434 | A * | 7/2000 | Lam | 160/330 |
| 6,431,248 | B1 | 8/2002 | Hyman et al. | |
| 6,484,787 | B1 | 11/2002 | Walters | |
| D468,950 | S | 1/2003 | Judkins | |
| D473,743 | S | 4/2003 | Judkins | |
| 6,637,493 | B1 | 10/2003 | Lampers | |
| 6,648,048 | B2 * | 11/2003 | Lai | 160/115 |
| 6,662,845 | B1 | 12/2003 | Palmer | |
| 6,817,399 | B2 | 11/2004 | Berman et al. | |
| 6,860,312 | B2 | 3/2005 | Judkins | |
| 6,918,425 | B2 | 7/2005 | Nien | |
| 6,948,546 | B2 | 9/2005 | Nien | |
| 6,988,526 | B2 * | 1/2006 | Judkins | 160/84.01 |
| 7,000,672 | B2 | 2/2006 | Nien | |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,318,251 | B2 | 1/2008 | Lin | |
| 7,624,784 | B2 | 12/2009 | Anthony et al. | |
| 7,658,218 | B2 * | 2/2010 | Lai | 160/115 |
| D651,438 | S * | 1/2012 | Lin | D6/575 |
| 2005/0092448 | A1 * | 5/2005 | Lin | 160/291 |
| 2006/0060308 | A1 * | 3/2006 | LeBlanc et al. | 160/84.04 |
| 2006/0144526 | A1 | 7/2006 | McGinley | |
| 2006/0157204 | A1 | 7/2006 | Lin | |
| 2007/0023149 | A1 | 2/2007 | Lamars et al. | |
| 2007/0175593 | A1 | 8/2007 | Lin | |
| 2008/0110581 | A1 | 5/2008 | Lin | |
| 2008/0277074 | A1 | 11/2008 | Lin | |
| 2008/0295975 | A1 | 12/2008 | Lin | |
| 2011/0126990 | A1 * | 6/2011 | Huang | 160/84.01 |
| 2011/0186242 | A1 * | 8/2011 | Foley et al. | 160/193 |
| 2011/0203079 | A1 * | 8/2011 | Anthony et al. | 24/115 F |
| 2011/0209834 | A1 * | 9/2011 | Lowry et al. | 160/84.04 |
| 2011/0220301 | A1 * | 9/2011 | Lin | 160/84.04 |
| 2011/0247765 | A1 * | 10/2011 | Lin | 160/133 |
| 2011/0308746 | A1 * | 12/2011 | LeBlanc | 160/340 |
| 2012/0103538 | A1 * | 5/2012 | Gleinser | 160/84.04 |
| 2012/0168094 | A1 * | 7/2012 | Lin | 160/84.04 |

OTHER PUBLICATIONS

U.S. Appl. No. 12/770,881, filed Apr. 30, 2010.
U.S. Appl. No. 12/780,245, filed May 14, 2010.

* cited by examiner

WINDOW COVERING

FIELD OF INVENTION

The present invention relates to window coverings such as Roman shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft folds across the face of the fabric. Consequently, the typical Roman shade has a cascaded or softly pleated appearance. Such Roman shades are constructed so that when they are raised from an extended position, they gather from the bottom in generally horizontal folds or pleats until the entire shade resides near the top of the window covering in a retracted position. In some versions, the top of the window covering may also be lowered. The shades are operated by pulling on various lift cords which are used in conjunction with guides attached to the shade.

Most prior art Roman shades are formed either of a sheet of a flexible material such as a fabric or film or of a plurality of segments of material connected together. The material or interconnected segments are typically provided with a plurality of horizontal folds at points vertically spaced from one another to form folds when the shade is raised. A common method for making a Roman shade is to sew at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. Opposite ends of the lift cords are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered. A liner may also be included in such shades. Roman shades may also have other configurations, such as the configurations disclosed in U.S. Pat. No. 6,662,845 and U.S. Patent Application Publication Nos. 2008/0295975, 2008/0277074, 2007/0175593, 2006/0060308 and 2006/0157204.

Roman shades may be fabricated by fabricators to make a Roman shade in a custom size to fit a customer's window opening. Fabricators may mistakenly measure or determine the necessary length of the window covering material of a Roman shade or the desired positioning of the rings on the back of the window covering material. For instance, a fabricator may want to adjust the position of the rings to achieve a different aesthetic effect for the raising and lowering of window covering material after reviewing the look provided by the initial positioning of the rings. Since rings are often sewn or affixed to the window covering material, such repositioning can be difficult and time consuming. Alternatively, Roman shades may include fastening mechanisms that permit fabricators to more easily adjust the position of the window covering material relative to the lift cords to which the window covering is attached. Examples of such devices are disclosed in U.S. Pat. Nos. 6,817,399 and 5,566,735.

On occasion, children have been able to get behind a lowered Roman shade and become entangled in one of the lift cords. If the lift cord is around the child's neck and the child falls, the cord could act as a noose and strangle the child. Indeed, reports of such incidents have prompted a major retailer to issue a recall of one product line of Roman shades and the United States Consumer Product Safety Commission has issued a warning about the danger of child entanglement and hanging from the cords in Roman shades.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for window coverings are visible from the front of the shade and detract from the aesthetic effect of the shade.

The art has also used a liner on the back of a Roman shade which covers the lift cords making them inaccessible to children. Liners add bulk to the shade and can affect the appearance of the shade as seen from the room, particularly when the Roman shade is raised and lowered. U.S. Pat. No. 6,988,526 discloses a Roman shade with a liner.

A new safety device is needed for Roman shades. Preferably, such a device can prevent the lift cords of a shade from coming into contact with a small child. Moreover, such a safety device preferably does not detract from the aesthetic effect provided by the Roman shade.

SUMMARY OF THE INVENTION

A window covering includes a first rail. Window covering material that is moveable from a retracted position to an extended position and a liner positioned adjacent to the rear side of the window covering material that is also moveable from a retracted position to an extended position. The liner is attached to at least one of the window covering material and to the first rail to define at least one cavity between the window covering material and the liner. At least one ladder is attached to the liner and positioned in the at least one cavity. The one or more ladders have a plurality of vertically spaced rungs. Each of the rungs of the one or more ladders have a front facing toward the rear side of the window covering material and a rear opposite the front of the rungs. A first lift cord extends from the first rail to a position adjacent to the bottom edge of the window covering material. A portion of the first lift cord extends through the one or more cavities. The first lift cord passes adjacent to the one or more ladders so that the first lift cord passes over the rungs of the one or more ladders so that the first lift cord alternatives from passing behind and in front of successive rungs. A second lift cord extends from the first rail to a position adjacent to the bottom edge of the window covering material. A portion of the second lift cord extends through the one or more cavities. The second lift cord passes adjacent to the one or more ladders so that the second lift cord passes over the rungs of the at least one ladder so that the second lift cord alternates from passing behind and in front of successive rungs.

Embodiments of the window covering may also include sets of parallel and vertically spaced connections between the liner and the window covering material adjacent. For instance, a first set of connections may be positioned adjacent to a first side of the liner and a second set of connections may be positioned adjacent to a second side of the liner that is opposite the first side of the liner. The first and second sides may be left and right sides of the liner, for example. The first and second sets of connections may be configured to propagate formation of generally horizontal folds in the liner when the window covering material is raised to the retracted position. Preferably, the sets of connections are sewn connections that are each formed by stitching that extends inwardly from the first or second side of the liner in a substantially horizontal direction.

A plurality of stiffening members may be attached to the window covering material. One of the first set of connections and one of the second set of connections may be positioned adjacent to a respective one of the stiffening members.

Embodiments of the window covering may include a lift control mechanism attached to the first rail. The lift cord control mechanism configured to control movement of the first lift cord and second lift cord. The liner comprised of fabric, mesh, interconnected fabric segments, or interconnected mesh segments. The window covering material may also be comprised of fabric, mesh, woven wood, woven grass, bamboo, interconnected fabric segments, or interconnected mesh segments.

The one or more ladders at least include two ladders for some embodiments. For instance, the first lift cord may pass adjacent to a first ladder so that the first lift cord passes over the rungs of the first ladder such that the first lift cord alternates from passing behind and in front of successive rungs of the first ladder. The second lift cord may pass adjacent to the second ladder so that the second lift cord passes over the rungs of the second ladder such that the second lift cord alternates from passing behind and in front of successive rungs.

In some embodiments, stiffening members may be positioned in the liner so that a length of each stiffening member is perpendicular to the first and second lift cords. Each stiffening member may include a rod, a shaft or a bar and be positioned between the first and second lift cords.

Some embodiments of the window covering may include a second rail. The second rail may be a bottom rail, for example. Some embodiments of the window covering may include only two rails, such that the first rail is a headrail or bottom rail and the second rail is the other of the headrail or bottom rail. In yet other embodiments, the window covering may be a top down bottom up shade. The first rail may then be a headrail or bottom rail and the second rail may be a bottom rail or an intermediate rail, for example.

In some embodiments of the window covering, the liner is comprised of mesh and the rung have end portions that are sewn to the liner. In yet other embodiments, the liner is composed of fabric and the rungs include members attached to the liner.

The liner may have a tope edge attached to the first rail to attach the first rail to the liner. The bottom edge of the liner may be attached to a bottom edge or bottom portion of the window covering material, a second rail, or both the bottom portion of the window covering material and the second rail.

In yet other embodiments of the window covering a first rail is connected to window covering material. A liner is positioned adjacent to the rear side of the window covering material and has at least one pocket. At least one ladder is attached to the liner and is positioned in the at least one pocket. Each ladder has a plurality of vertically spaced rungs. First and second lift cords extend from the first rail to a position adjacent to the bottom edge of the window covering material. Portions of the first and second lift cords extend through the channel of the at least one pocket and pass adjacent to the one or more ladders so that the cords pass over the rungs of the one or more ladder such that the cords alternate from passing behind and in front of successive rungs.

In some embodiments of the window covering, the at least one pocket may include two or more pockets. Each pocket may retain a respective ladder and lift cord. In some embodiments of the window covering, the liner may be a double liner.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my window covering are shown in the accompanying drawings and certain present preferred methods of practicing the same are also illustrated therein.

FIG. 2 illustrates rungs of a ladder positioned within a channel formed between a liner and the window covering material and how a lift cord passes over the front and rear sides of the rungs of ladder. A portion of a double liner 5*a* is shown in dotted line in FIG. 2.

DESCRIPTION OF PRESENT PREFERRED EMBODIMENTS

Figure 1:
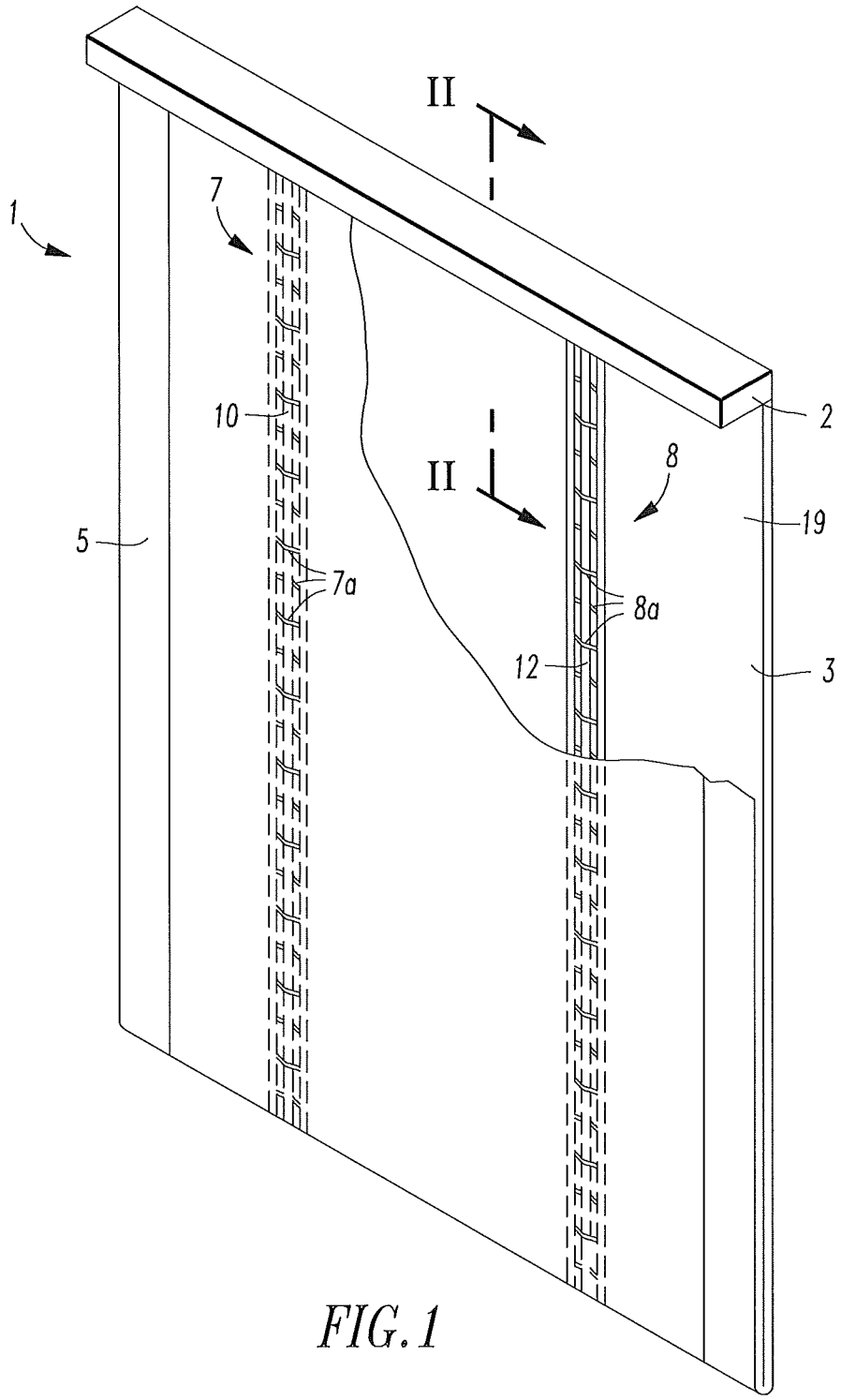
FIG. 1 is a rear view of a first present preferred embodiment of the window covering. A portion of the lift cords and ladders positioned in the liner are shown in broken line and a portion of the liner is cut away to illustrate a portion of a ladder and a lift cord positioned adjacent to the liner.
Figure 2:
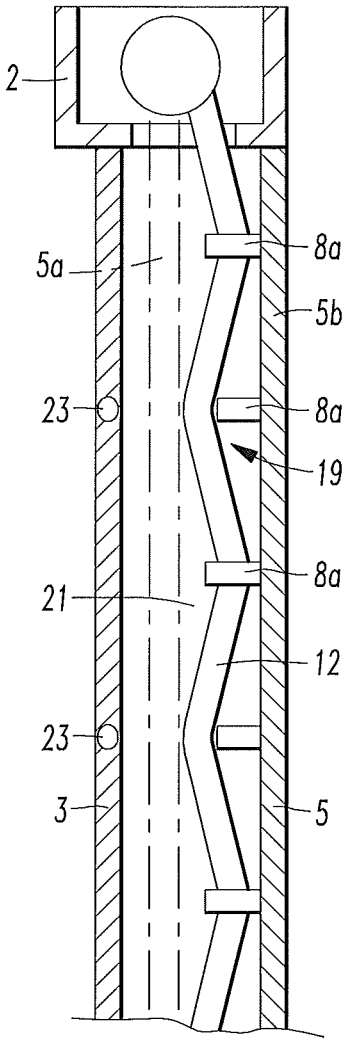
FIG. 2 is a fragmentary cross sectional view of the first present preferred embodiment of the window covering taken along line II-II shown in FIG. 1.
Figure 3:
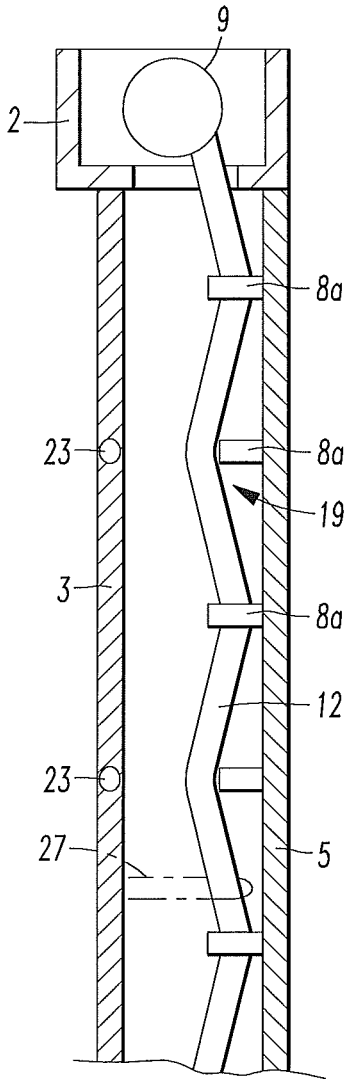
FIG. 3 is a fragmentary cross sectional similar to FIG. 2 and shows an optional ring in dotted line that may be attached to the window covering material to receive a portion of the lift cord.

Referring to FIGS. 1-4, a window covering 1 includes a mounting device 2 and window covering material 3 attached to the mounting device 2. The mounting device 2 may include a headrail and brackets (not shown) that are used to mount the headrail adjacent to a window opening. Alternatively, the headrail may be directly fastened adjacent to a window opening.

The window covering material 3 may be a sheet of fabric, interconnected segments of fabric or mesh, woven wood, woven grass, mesh, bamboo, or other materials which have been used for window coverings. Stiffening members 23 may be positioned in or attached to the window covering material to help the window covering material form folds when the window covering material is raised. The stiffening members 23 may be, for instance, rods or bars attached to the window covering material 3 or within pockets in the window covering material.

A liner 5 is attached to the window covering material 3 and may also have a top edge connected to mounting device 2. A lightweight fabric is preferred for the liner. The liner may be a sheet composed of fabric, a mesh material or other material. The liner may be attached to the window covering material 3 and the mounting device 2 to define a channel or cavity 19 between the liner 5 and the window covering material 3. For instance, the left and right edges may be sewn, welded or otherwise adhered adjacent to the edges of the window covering material and the bottom edge of the liner may also be similarly attached to the bottom edge of the window covering material. The liner 5 is preferably attached to the window covering material 3 in a manner so that a child will not have access to any lift cord that may be positioned within the cavity 19. The liner prevents children from grabbing the lift cords or becoming entangled within the lift cords.

Figure 4:
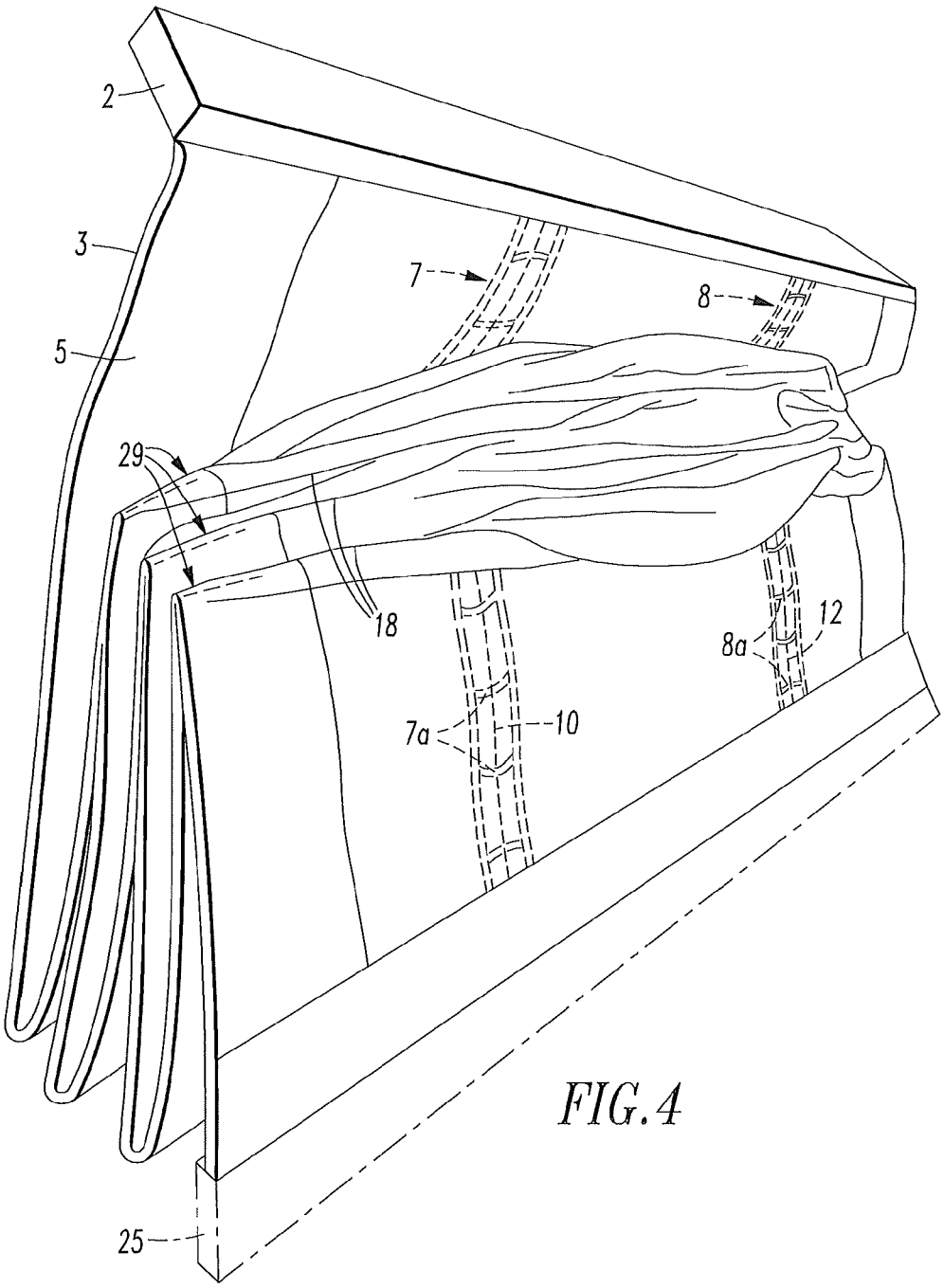
FIG. 4 is a rear side perspective view of the first present preferred embodiment of the window covering in a raised or retracted position. An optional bottom rail 25 that may be included in embodiments of the window covering is shown in dotted line in FIG. 4.

If desired, a bottom rail 25, which is shown in dotted line in FIG. 4 may be included in the window covering. Preferably, the window covering material 3 and the liner 5 are attached to the bottom rail 25. The bottom rail 25 may be a generally rectangular shaped member or a tube or rod that is attached to the bottom edge of the liner and the bottom edge of the window covering material 3. A distal end of each lift cord may be attached to the bottom rail 25 as well.

A first lift cord 10 and a second lift cord 12 may extend from the mounting device 2 to adjacent to a bottom edge of the window covering material 3. Each lift cord may be a cord, a strip, ribbon, or a lifting tape. One end of each lift cord may be attached to a lift mechanism 9 that may include a roller or spool positioned in the headrail and the opposite end may be attached to the window covering material. Each lift cord may be unwound or wound from the roller or spool to raise and lower the window covering material. A loop cord drive, spring motor, roller spring or other lift cord control mechanism may be utilized to actuate movement of the lift cords. In yet other embodiments, a portion of each lift cord may pass through a cord lock or be connected to an operator cord that passes through a cord lock so that a user may move the lift cords or the operator cord to raise or lower the window covering.

A portion of each lift cord may extend from the mounting device 2 adjacent to the liner 5 within the cavity 19 or channel Each lift cord may be positioned close enough to the liner 5 that the lift cords engage a portion of the liner when the lift cords move to raise or lower the window covering material.

A first ladder 7 and a second ladder 8 are attached to the liner 5 in the cavity 19. The first ladder has a plurality of vertically spaced rungs 7*a* and the second ladder 8 also has a plurality of vertically spaced rungs 8*a*. The rungs 7*a* of the first ladder may be parallel with each other and the rungs 8*a* of the second ladder may be parallel to each other. Each rung 7*a* and 8*a* may be defined by one or more strands of thread or a cord, or a piece of fabric or other material attached to the liner to form a rung. The first cord passes adjacent the first ladder 7 and the second lift cord passes adjacent to the second ladder 8. Preferably the lift cords pass behind and in front of successive rungs 7*a*, 8*a* as shown most clearly in FIGS. 2 and 3.

The lift cords alternatively passing over the front and rear sides of successive rungs helps the liner 5 form attractive generally horizontal folds 18 when the window covering is moved to a raised position. The liner could instead form an unattractive bunched appearance if the lift cords did not successively alternate over adjacent rungs.

Additionally, a plurality of horizontal or generally horizontal sewn connections 29 may be made between portions of the liner 5 adjacent to the side edges of the liner and the window covering material as shown in FIG. 4. The sewn connections 29 may be positioned adjacent to stiffening members 23 positioned in the window covering material 3. The sewn connections 29 may be vertically spaced apart from one another in two different parallel rows adjacent to opposite sides of the liner 5. Each sewn connection may have stitching that extends such that the stitching in each connection extends in a direction that is parallel to the length of the stiffening members 23. The sewn connections may work in combination with the ladders 7 and 8 to facilitate formation of the horizontal folds 18 in the liner 5 when the window covering material is raised. It is contemplated that an adhesive or ultrasonic weld may be formed between the liner 5 and the window covering material 3 at the connection locations of the stitching connections in alternative embodiments. In yet other alternative embodiments, a fastening device such as a staple may be used for connecting the liner and window covering material to help form the horizontal folds 18.

In some embodiments of the window covering 1, the liner 5 may be a double liner. For such embodiments, an outer portion 5*b* of the liner and an inner portion 5*a*, of the liner which is shown in dotted line in FIG. 2, may define a channel 21. The ladders 7 and 8 may be attached to the liner and be positioned in one or more channels formed between the two portions, or inner and outer sides, of the double liner. When a double liner is used, the liner may not be attached to the edges of the window covering material or headrail to form a cavity 19 because the lift cords may be enclosed within the liner and headrail to prevent access to the lift cords. Instead, the liner may only be attached to a portion of the window covering material or a portion of the headrail.

In yet other embodiments of the window covering, a series of rings 27 may be attached to the window covering material. The rings 27 may be positioned in the cavity 19 and may be configured to receive a portion of a lift cord. There may be a set of vertically spaced rings for each lift cord in different parallel rows. The rings 27 may help facilitate the formation of transverse folds in the window covering material 3 when the material is raised or lowered.

In yet other embodiments, the liner may be formed to have pockets as disclosed in my U.S. patent application Ser. No. 12/720,050. The entirety of U.S. patent application Ser. No. 12/720,050 is incorporated herein by reference. One or more ladders may be attached to the liner such that each ladder is positioned in a respective pocket formed in the liner. The lift cords may extend through the pockets such that the lift cords alternate between passing over a front or rear side of successive rungs of the ladders to help the liner form attractive horizontal folds 18 when the window covering material is raised.

Figure 5:
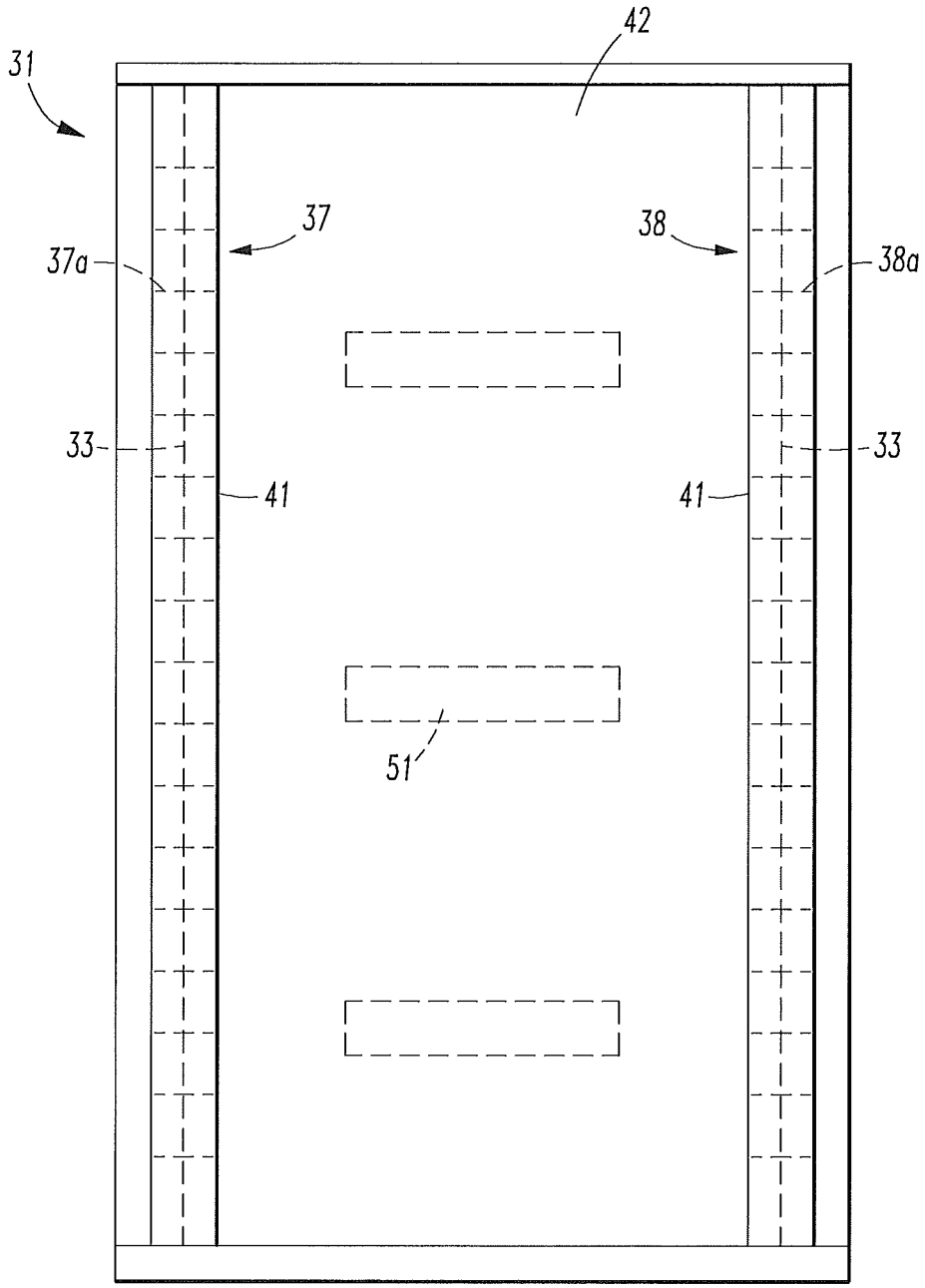
FIG. 5 is a rear view of a second present preferred embodiment of the window covering.

An example of an embodiment of the window covering 31 that includes ladders 37 and 38 positioned in channels defined by pockets 41 formed in a liner 42 is shown in FIG. 5. The lift cords 33 and rungs 37*a* and 38*a* of the ladders are shown in dotted line in FIG. 5. The lift cords may pass over the rungs of the ladders such that each lift cord alternates from passing behind and in front of successive rungs of the ladders. It should be understood that a lift cord control mechanism may be attached to the headrail of the window covering 31. Also, a bottom rail may be connected to a bottom portion of the liner, bottom portion of the window covering material, and end portions of the lift cords in the window covering 31. Stiffening members 51 may be attached in the liner as well. The stiffening members may be rods, bars or shafts that may provide weight to the liner to help facilitate the formation of generally horizontal folds when the liner is raised.

While certain present preferred embodiments of my window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail;

window covering material positioned adjacent to the first rail, the window covering material moveable from a retracted position to an extended position, the window covering material having a top edge and a lower edge below the top edge, a front side and a rear side opposite the front side;

a liner positioned adjacent to the rear side of the window covering material, the liner moveable from a retracted position to an extended position, the liner attached to at least one of the window covering material and the first rail to define at least one cavity within the liner;

at least one ladder attached to the liner and positioned in the at least one cavity, the at least one ladder having a plurality of vertically spaced rungs, each of the rungs of the at least one ladder having a front facing toward the rear side of the window covering material and a rear opposite the front of the rungs;

a first lift cord extending from the first rail to a position adjacent to the bottom edge of the window covering material to move the window covering material from the extended position to the retracted position, a portion of the first lift cord extending through the at least one cavity, the first lift cord passing adjacent to the at least one ladder such that the first lift cord passes over the rungs of the at least one ladder such that the first lift cord alternates from passing behind and in front of successive rungs; and a second lift cord extending from the first rail to a position adjacent to the bottom edge of the window covering material to move the window covering material from the extended position to the retracted position, a portion of the second lift cord extending through the at least one cavity, the second lift cord passing adjacent to the at least one ladder such that the second lift cord passes over the rungs of the at least one ladder such that the second lift cord alternates from passing behind and in front of successive rungs.

2. The window covering of claim 1 further comprising a lift cord control mechanism attached to the first rail, the lift cord control mechanism configured to control movement of the first lift cord and the second lift cord to raise and lower the window covering material between the extended and retracted positions.

3. The window covering of claim 1 wherein the liner is comprised of fabric, interconnected fabric segments, mesh, or interconnected mesh segments.

4. The window covering of claim 1 further comprising a second rail, the second rail attached to at least one of the bottom edge of the window covering material, and a portion of the first lift cord and a portion of the second lift cord.

5. The window covering of claim 1 wherein a length of the cavity extends in a direction substantially perpendicular to a length of the first rail.

6. The window covering of claim 1 wherein the window covering material is comprised of fabric, woven wood, woven grass, interconnected fabric segments, or bamboo.

7. The window covering of claim 1 wherein the liner is a double liner.

8. The window covering of claim 1 wherein the liner is comprised of a sheet of mesh material and the rungs of the at least one ladder have end portions that are sewn to the liner.

9. The window covering of claim 8 wherein the liner and the first rail enclose the first and second lift cords when the window covering material is in the extended position and when the window covering material is in the retracted position and wherein the liner has a top edge and a bottom edge opposite the top edge, and the top edge of the liner is attached to the first rail to attach the liner to the first rail.

10. The window covering of claim 1 wherein the at least one ladder is comprised of a first ladder within the liner and a second ladder within the liner; and wherein the first lift cord passing adjacent to the first ladder such that the first lift cord passes over the rungs of the first ladder such that the first lift cord alternates from passing behind and in front of successive rungs of the first ladder; and wherein the second lift cord passing adjacent to the second ladder such that the second lift cord passes over the rungs of the second ladder such that the second lift cord alternates from passing behind and in front of successive rungs.

11. The window covering of claim 10 further comprising at least one stiffening member attached to the window covering material.

12. The window covering of claim 10 further comprising a plurality of stiffening members, each stiffening member positioned within the liner such that each stiffening member is substantially perpendicular to the first and second lift cords.

13. The window covering of claim 12 wherein each stiffening member is comprised of a rod, shaft or bar and wherein each stiffening member is positioned between the first lift cord and the second lift cord.

14. A window covering comprising:

a first rail;

window covering material positioned adjacent to the first rail, the window covering material moveable from a retracted position to an extended position, the window covering material having a top edge and a lower edge below the top edge, a front side and a rear side opposite the front side;

a liner positioned adjacent to the rear side of the window covering material, the liner moveable from a retracted position to an extended position, the liner attached to at least one of the window covering material and the first rail to define at least one cavity between the window covering material and the liner;

at least one ladder attached to the liner and positioned in the at least one cavity, the at least one ladder having a plurality of vertically spaced rungs, each of the rungs of the at least one ladder having a front facing toward the rear side of the window covering material and a rear opposite the front of the rungs;

a first lift cord extending from the first rail to a position adjacent to the bottom edge of the window covering material, a portion of the first lift cord extending through the at least one cavity, the first lift cord passing adjacent to the at least one ladder such that the first lift cord passes over the rungs of the at least one ladder such that the first lift cord alternates from passing behind and in front of successive rungs;

a second lift cord extending from the first rail to a position adjacent to the bottom edge of the window covering material, a portion of the second lift cord extending through the at least one cavity, the second lift cord passing adjacent to the at least one ladder such that the second lift cord passes over the rungs of the at least one ladder such that the second lift cord alternates from passing behind and in front of successive rungs; and a first set of parallel and vertically spaced direct connections between the liner and the window covering material adjacent to a first side of the liner and a second set of parallel and vertically spaced direct connections between the liner and the window covering material adjacent to a second side of the liner that is opposite the first side of the liner, the first and second sets of connections propagating formation of generally horizontal folds in the liner when the window covering material is raised.

15. The window covering of claim 14 wherein the first and second set of direct connections are sewn connections, each of the sewn connections being formed by stitching that extends in a substantially horizontal direction.

16. The window covering of claim 15 further comprising a plurality of stiffening members attached to the window covering material and wherein one of the first set of connections and one of the second set of connections is positioned adjacent to a respective one of the stiffening members.

17. A window covering comprising:

a first rail;

window covering material positioned adjacent to the first rail, the window covering material moveable from a retracted position to an extended position, the window covering material having a top edge and a lower edge below the top edge, a front side and a rear side opposite the front side;

a liner positioned adjacent to the rear side of the window covering material, the liner moveable from a retracted position to an extended position, the liner defining at least one channel;

at least one ladder attached to the liner and positioned in the at least one channel, the at least one ladder having a plurality of vertically spaced rungs, each of the rungs of the at least one ladder having a front facing toward the rear side of the window covering material and a rear opposite the front of the rungs;

a first lift cord extending from the first rail to a position adjacent to the bottom edge of the window covering material to move the window covering material from the extended position to the retracted position, a portion of the first lift cord extending through the at least one channel, the first lift cord passing adjacent to the at least one ladder such that the first lift cord passes over the rungs of the at least one ladder such that the first lift cord alternates from passing behind and in front of successive rungs; and a second lift cord extending from the first rail to a position adjacent to the bottom edge of the window covering material to move the window covering material from the extended position to the retracted position, a portion of the second lift cord extending through the at least one channel, the second lift cord passing adjacent to the at least one ladder such that the second lift cord passes over the rungs of the at least one ladder such that the second lift cord alternates from passing behind and in front of successive rungs.

18. The window covering of claim 17 wherein the at least one channel is comprised of a first channel and a second channel, the first channel defined by a first pocket of the liner and the second channel defined by a second pocket of the liner, a portion of the first lift cord extending through the first channel and a portion of the second lift cord extending through the second channel.

19. The window covering of claim 18 wherein the at least one ladder is comprised of a first ladder and a second ladder, the first ladder positioned in the first pocket and the second ladder is positioned in the second pocket and the first and second lift cords are enclosed within the liner and the first rail when the window covering material is in the extended position and the first and second lift cords are enclosed within the liner and the first rail when the window covering material is in the retracted position; and wherein the first lift cord passing adjacent to the first ladder such that the first lift cord passes over the rungs of the first ladder such that the first lift cord alternates from passing behind and in front of successive rungs of the first ladder; and wherein the second lift cord passing adjacent to the second ladder such that the second lift cord passes over the rungs of the second ladder such that the second lift cord alternates from passing behind and in front of successive rungs.

20. The window covering of claim 19 wherein the liner is a double liner.

* * * * *